US008763941B1

(12) United States Patent
Beck, Jr.

(10) Patent No.: US 8,763,941 B1
(45) Date of Patent: Jul. 1, 2014

(54) BOTTLE SHREDDER HAVING A BOTTLE SHAPED HOUSING

(76) Inventor: Lawrence V. Beck, Jr., Downingtown, PA (US)

( * ) Notice: Subject to any disclaimer, the term of this patent is extended or adjusted under 35 U.S.C. 154(b) by 312 days.

(21) Appl. No.: 13/199,055

(22) Filed: Aug. 18, 2011

(51) Int. Cl.
*B02C 19/00* (2006.01)

(52) U.S. Cl.
USPC ..... 241/99; 241/100

(58) Field of Classification Search
CPC ..... B02C 19/0093; B02C 19/0087; B02C 19/0081
USPC ..... 241/99, 100, 55, 24.11
See application file for complete search history.

(56) References Cited

U.S. PATENT DOCUMENTS

| | | | | |
|---|---|---|---|---|
| 3,181,802 | A | 5/1965 | Lung et al. | |
| 3,655,138 | A * | 4/1972 | Luscombe | 241/99 |
| 3,946,662 | A | 3/1976 | Ross et al. | 100/240 |
| 4,669,673 | A | 6/1987 | Lodovico et al. | 241/99 |
| 4,784,251 | A | 11/1988 | DeWoolfson et al. | 194/209 |
| 4,871,118 | A | 10/1989 | Maloney | 241/99 |
| 5,042,634 | A | 8/1991 | Gulmini | 194/209 |
| 5,106,026 | A | 4/1992 | Baron | 241/99 |
| 5,111,927 | A | 5/1992 | Schulze, Jr. | |
| 5,242,126 | A | 9/1993 | Bomze | 241/94 |
| 5,355,987 | A | 10/1994 | DeWoolfson et al. | 194/209 |
| 5,402,872 | A | 4/1995 | Clurman | 194/209 |
| 5,423,492 | A | 6/1995 | Willis | 241/81 |
| 6,149,955 | A | 11/2000 | Wilson | 426/112 |
| 6,957,784 | B1 | 10/2005 | Barkan et al. | 241/99 |
| 7,546,965 | B1 | 6/2009 | Parkin | 241/99 |
| 8,366,030 | B2 * | 2/2013 | Jeon | 241/34 |

OTHER PUBLICATIONS

Lawrence V. Beck, Jr., Two web pages of mymrgreen.com consisting of pages/index and/contact dated Sep. 29, 2009.

* cited by examiner

*Primary Examiner* — Mark Rosenbaum
(74) *Attorney, Agent, or Firm* — Petock & Petock, LLC

(57) ABSTRACT

Apparatus provided for reducing the volume of trash generated from plastic bottles and containers whether destined for landfill or not. The apparatus includes a shredder mounted within an aesthetically pleasing and functionally suggestive beverage bottle shaped housing. A chute with a plunger is provided which forces the plastic bottles against blades rotated on a substantially horizontally mounted disk with a fan for directing the shredded particles into a duct for transport to a bin within the bottle shaped housing. A pan structure is provided to collect any fluid remaining in the bottles being shredded and directed via a duct to the bin.

10 Claims, 3 Drawing Sheets

FIG.1
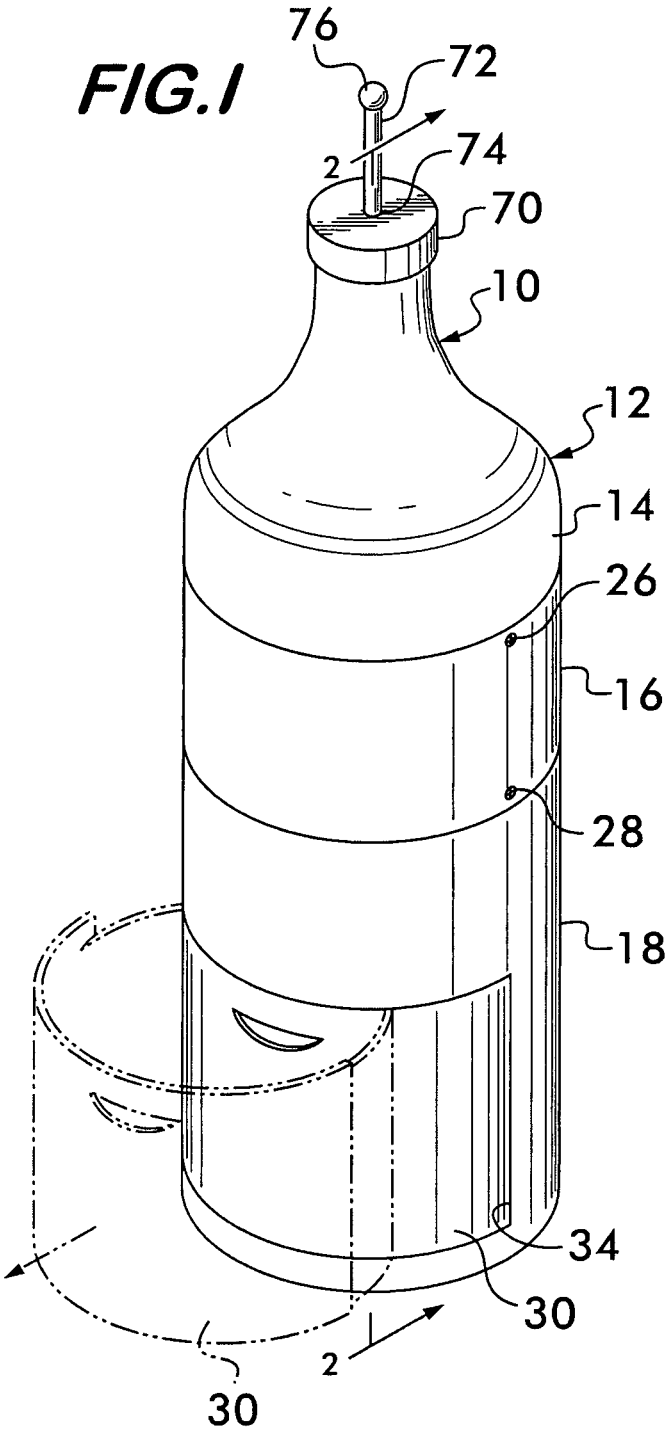
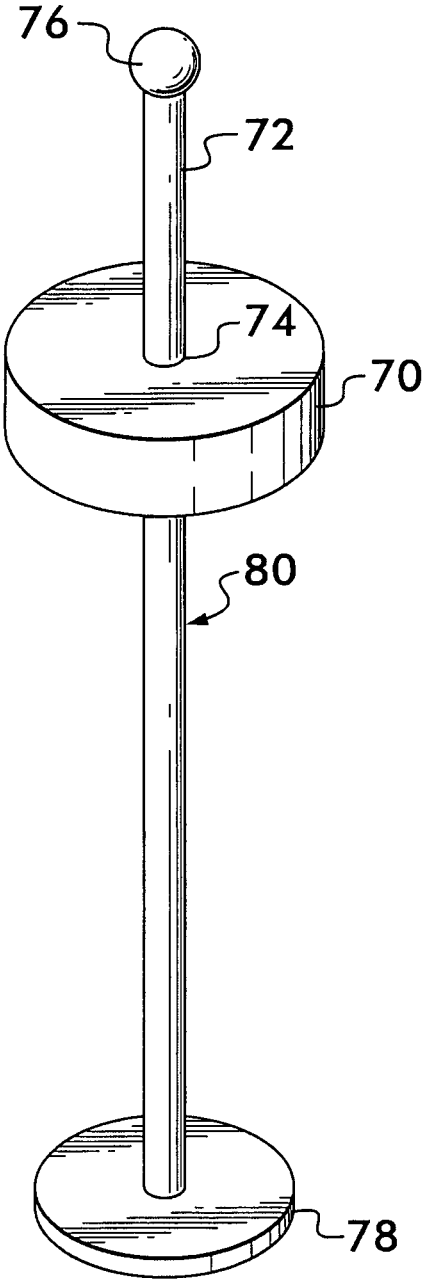
FIG.3

72
32
10
90
80
12
14
14
78
26
22
5
5
62
40
44
46
16
28
24
58
56
120
100
112
6
6
60
18
34
30
20
40

BOTTLE SHREDDER HAVING A BOTTLE SHAPED HOUSING

FIELD OF THE INVENTION

The present invention relates to a bottle shredder having a bottle shaped housing. More particularly, the present invention relates to a bottle shredder for use by consumers of bottles in the home, office and other similar locations where bottles used by consumers and now empty may be shredded to reduce the volume that needs to be transported and stored for recycling purposes.

BACKGROUND OF THE INVENTION

Plastic bottles are today widely used for the transportation and sale of products to consumers including, but not limited to bottled water, soda, juices, fruits, ketchup and numerous other products.

The disposal of these bottles has become a national and international problem. The transportation and disposal of empty plastic bottles has become a major problem for landfills. In many areas, recycling of plastic bottles has been made mandatory. Nevertheless, there is a continuing problem with used, empty bottles taking up large amounts of space in storage and in transporting the empty bottles to landfills or recycling plants. There is an even worse problem where the bottles are disposed of in a landfill requiring large amounts of volume in the landfill.

There is a continuing problem even where the used and emptied bottles are transported to a recycling facility as the empty used bottles require much space for storage in the home, office or business for storage of these empty bottles until they are picked up for recycling by a recycling truck, and usually large trucks are required because of the volume generated by the empty used bottles.

Efforts have been made in the past at reducing the volume of trash materials such as plastic bottles, glass bottles and other trash. These have included various structures large and small which include compaction, grinding and housing of various shapes. For example, see U.S. Pat. No. 6,520,435 B1—Robinson; U.S. Pat. No. 4,669,673—Lodovico et al.; U.S. Pat. No. 7,546,965 B1—Parkin; U.S. Pat. No. 3,946,662—Ross, Jr., et al.; U.S. Pat. No. 5,242,126—Bomze and U.S. Pat. No. 5,106,026—Baron.

SUMMARY OF THE INVENTION

The present invention significantly reduces the amount of volume required to store in a home, office, business or other location where the products are consumed from a plastic bottle and reduce the volume of material to be transmitted to a recycling plant or other location such a landfill.

An advantage of the present invention is that it shreds plastic bottles in a consumer setting such as a home, office, business or other location where products are consumed from plastic bottles.

Another advantage of the present invention is that it produces a pleasing and aesthetic appearance.

Another advantage of the present invention is that it aesthetically suggests its function.

Another advantage of the present invention is that it completes one of the steps typically required in the recycling process, that is the shredding of the bottles.

Another advantage of the present invention is that it may be economically produced such that one may be utilized in every residential setting.

Another advantage of the present invention is that it may be used by governments and other organizations which pick up recycling materials such as plastic bottles for transport to recycling plants.

Briefly and basically, in accordance with the present invention an apparatus is provided in the form of a decorative housing shaped in the form of a bottle, particularly a beverage bottle, having an opening in an upper portion for receiving plastic bottles and a bin in a lower portion for receiving shredded plastic. The bin is slidably removable or at least extendable out from the bottle shaped decorative housing. A shredder having a rotating disk with blades thereon spaced from said disk is mounted within the readily recognizable bottle decorative housing for shredding plastic bottles into shredded plastic which is collected by the shredder into the bin. The decorative housing suggests immediately that the apparatus is for the disposal of plastic bottles and the design generates interest in the shredding of the plastic bottles. No compaction is required. The apparatus is light weight, requires minimal space and is economical due at least in part to the fact that no hydraulic or other compaction equipment is required. In this manner used plastic bottles may be conveniently shredded by a consumer of the contents of the bottles for reduction in volume for storage and/or transportation for emptied bottles.

In a presently preferred embodiment, the shredder is in the form of a disk having blades mounted thereon and separated from the disk by a spacer. The disk is rotated by an electric motor.

BRIEF DESCRIPTION OF THE DRAWINGS

For the purpose of illustrating the invention, there are shown in the drawings forms which are presently preferred; it being understood, however, that this invention is not limited to the precise arrangements and instrumentalities shown.

FIG. 1 is a view in perspective of a bottle shredder having a bottle shaped housing in accordance with the present invention.

FIG. 3 is a view in perspective of a plunger used in a bottle shredder as illustrated in FIGS. 1 and 2.

DETAILED DESCRIPTION OF THE PREFERRED EMBODIMENTS

Figures 2, 2A:
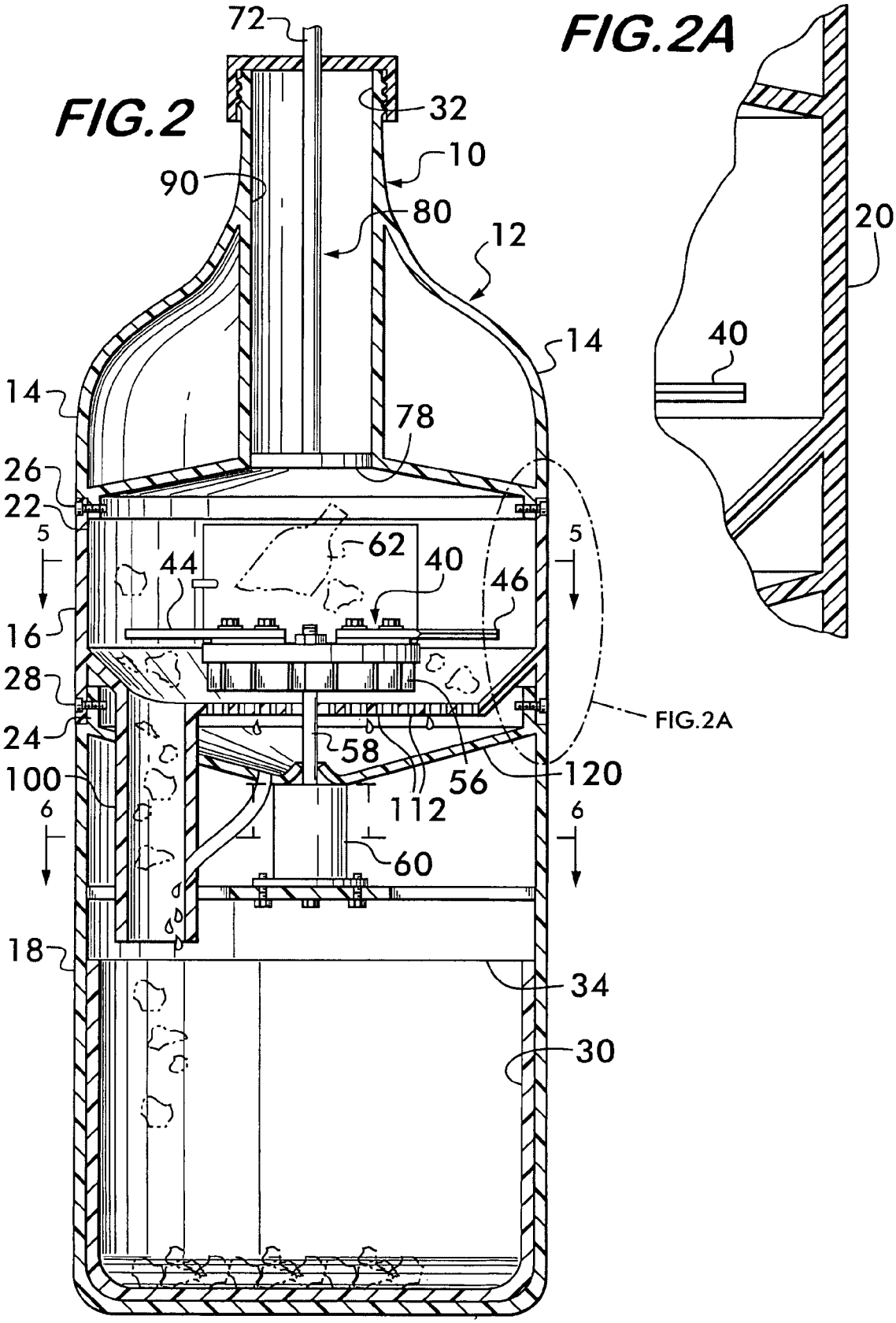
FIG. 2 is a cross sectional view taken along line 2-2 of FIG. 1.
FIG. 2A is a broken away cross section of the region in dotted lines in FIG. 2, labeled FIG. 2A showing an alternate embodiment of the invention illustrated in FIGS. 1 and 2 wherein the bottle shaped housing is comprised of a unitary structure.

Referring now to the drawings, wherein like numerals indicate like elements, there is shown in FIGS. 1, 2 and 3 a bottle shredder 10 having a bottle shaped housing 12. The bottle shaped housing 12 may be comprised of multiple sections and as illustrated in FIGS. 1 and 2, may be comprised of three sections 14, 16 and 18. Any other suitable number of sections may be utilized instead of 3, such as 2, 4 or 5 or any other suitable number. The sections 14, 16 and 18 may be held together by friction fit or snap together structure as illustrated in FIG. 2, at 22 and 24. Additionally, to insure against any possibility of the housing coming apart should the bottle shredder 10 be knocked over or the like, screws 26 and 28 may be placed in the snap or friction fit joints 22 and 24, respectively.

Alternatively and presently preferred, the housing 12 would be comprised of a unitary structure as illustrated in FIG. 2A, illustrating housing 20 without sections or joints.

As illustrated in FIGS. 1 and 2, bottle shredder 10 has a decorative housing 12 shaped in the form of a bottle having an opening 32 in its upper portion for receiving plastic bottles. The plastic bottle shaped housing 12 (and in the alternative embodiment 20) presents an aesthetically pleasing appearance and suggests the functionality of the shredder, that is the shredding of plastic bottles, particularly beverage bottles. Housings 12 and 20 are also provided with a receptacle or a bin 30 (as illustrated in FIGS. 1 and 2 with respect to housing 12). Bin 30 is received into an opening 34 in bottom section 18 of housing 12. Bin 30 in lower or bottom section 18 or portion of housing 12 for receiving shredded plastic from the shredder. Bin 30 is slidably removable or at least extendable out from bottle shaped decorative housing 12, and particularly from section 18 of housing 12 in the embodiment of FIGS. 1 and 2.

Figure 4:
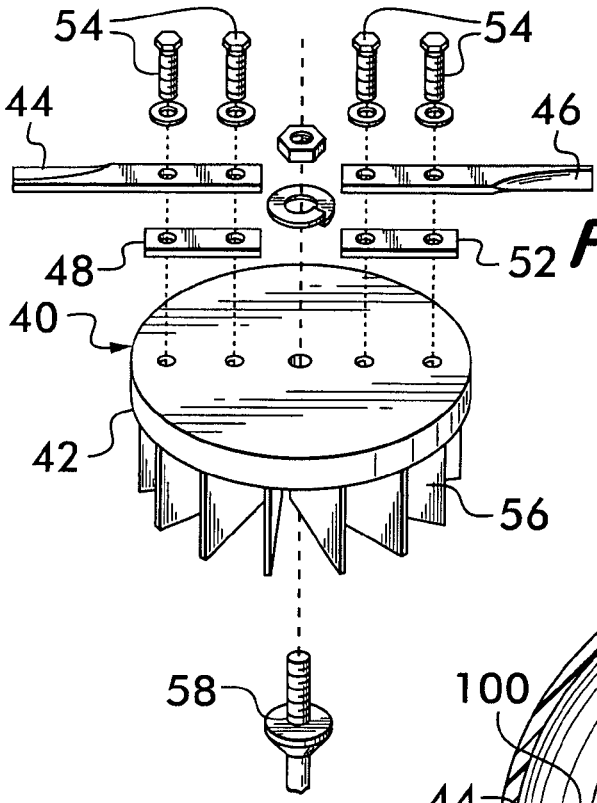
FIG. 4 is an exploded view of a rotatable disk having blades mounted to an upper portion of said disk and separated from said disk by spacer elements and also having a fan formed on its lower surface.

A shredder 40 is mounted within housing 12 or housing 20. In a presently preferred embodiment, shredder 40 may be comprised of a substantially horizontally disk 42 driven by a motor having one or more blades mounted to a upper surface of the disk and spaced from the upper surface of the disk as illustrated in FIG. 4. In a presently preferred embodiment, there would be two shredder blades 44 and 46 separated from disk 42 by spacers 48 and 52. In a presently preferred embodiment, the blades and spacers may be held to the upper surface of disk 40 by means of threaded fasteners 54. It is presently preferred to use threaded fastener so that blades may be removed and replaced as needed. The blades may be removed for sharpening or new blades may be installed. However, it is understood that other means of fastening blades 44 and 46 to the upper surface of disk 42 may be utilized. No crushing or compaction of the bottle is required prior to shredding or thereafter.

The lower surface of disk 40 is provided with fan blades or fins 56. Fan fins 56 are useful in causing air movement to cause the shredded chips to be thrown to the outer periphery of the inner surface of housing 12, 20 and particularly to the periphery of the inner surface of section 16 allowing the chips to pass through duct 100 into bin 30. Disk 42 is mounted on spindle or motor shaft 58 and driven by electric motor 60. It is understood that blades 44 and 46 may be sharpened their entire length and with a spacer, provides a means to chip away at a plastic bottle or other plastic container being forced onto rotating disk 42. It is also understood that a single blade may be used or more than two blades may be used. Preferably, blades would be in pairs so that they may be balanced on disk 42.

The rotating disk with blade(s) horizontally mounted is light weight, economical and less space intensive than using a hydraulic compactor or the like and a grinder.

Bottles and other plastic containers such as plastic jars and the like may be fed into bottle shredder 10 through opening 32 in an upper portion of the housing 12 of bottle shredder 10, and specifically in top section 14 of bottle shredder 10.

By definition throughout, plastic bottles herein is defined herein throughout, including in the claims, to mean plastic bottles and any other type of plastic container including plastic jars and the like in which customers receive product and need to dispose of the container after it has been emptied.

In order to place the plastic bottle in opening 32, cap 70 is removed. As illustrated in FIG. 2, cap 70 may be threadably mounted onto top section 14 of bottle shredder housing 12. Cap 70 has a plunger rod 72 mounted through an opening in the center of cap 70. The structure of cap 70 and plunger 80 including plunger rod 72 is best illustrated in FIGS. 3 and 2. Plunger rod 72 is slidably mounted in opening 74 of cap 70. Plunger rod 72 is provided with a handle 76 and a flat bottle pushing structure 78 at its lower end. The flat pushing structure 78 of plunger 80 rides in chute 90.

In placing bottles in chute 90, cap 70 is threadably removed or unscrewed from top section 14 of housing 12 and removed along with plunger 80. One or more bottles, including any other type of plastic container, may be placed into chute 90, cap 70 replaced onto top section 14 of housing 12 and pushed down if necessary by applying pressure to handle 76 of plunger 80. Cap 70, where it is threadably mounted onto top section 14 may be provided with an interlock to prevent operation of shredder 40 when the cap is removed. In other words, this could be a micro switch mounted in the thread portion in the top of top section 14. This would break the circuit to supply electric power to motor 60 when the cap is removed. Motor 60 may be a DC motor operated on batteries or provided with an electrical power cord for plugging into standard volt AC power or other suitable electrical power.

In FIG. 2, a bottle 62 is indicated in dotted lines as being shredded by rotating blades 44 and 46 mounted on disk 42 of shredder 40. The shredded pieces are blown to the periphery of the interior of middle section 16 of housing 12. These shredded pieces of plastic may be blown to the periphery by the fan fins 56 on the lower or bottom surface of disk 42. The pieces of shredded plastic are dropped through duct 100 into bin 30. Duct 100 is best illustrated in FIG. 2 and is shown in cross section in FIG. 6.

Figure 5:
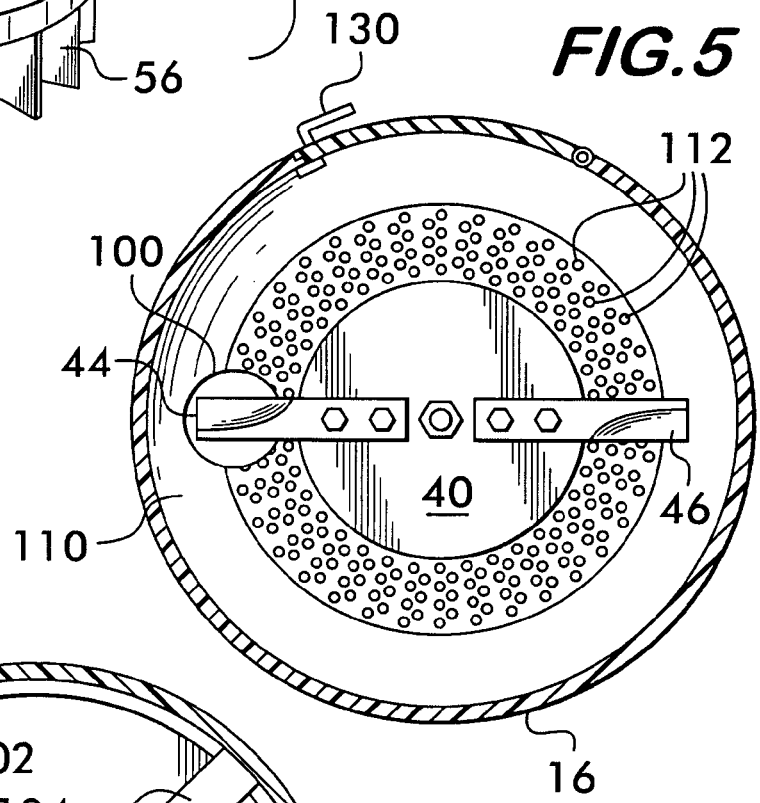
FIG. 5 is a cross sectional view taken along line 5-5 of FIG. 2.

A frustro-conical shaped pan 110 is mounted under shredder 40. This is best seen in FIGS. 2 and 5. Frustro-conical shaped pan 110 has openings or apertures 112 formed in a lower area of the pan except for the area immediately around motor shaft 58. Apertures 112 allow any water or any other fluid or liquid contained within any of the bottles or containers being shredded to drain through frusto-conical pan 100 and be caught by pan 120. Pan 120 has a central area around shaft motor shaft 48 turned upwardly to prevent water or other fluids from going into motor 60. Pan 120 is provided with a drain tube 122 which allows drainage of the fluid into duct 100 and from there into bin 30.

Figure 6:
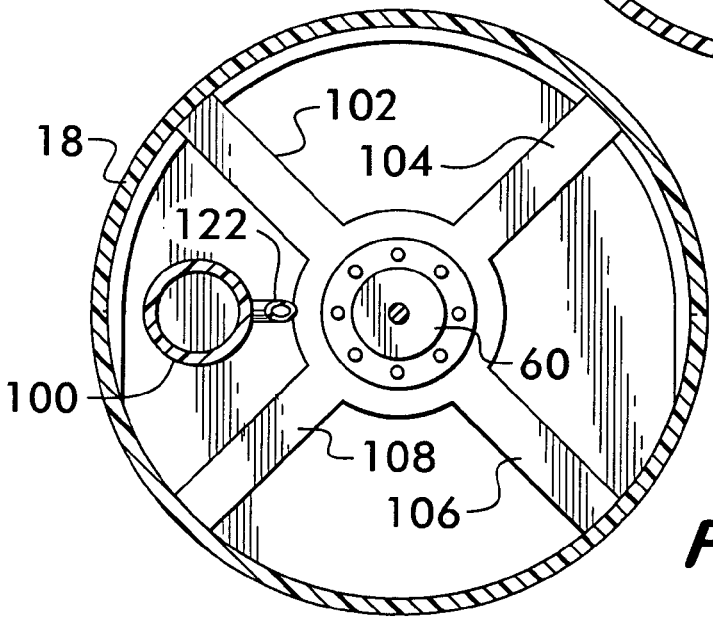
FIG. 6 is a cross sectional view taken along line 6-6 of FIG. 2.

FIG. 6 is a cross sectional view showing motor support arms 102, 104, 106 and 108 for supporting electric motor 60. Duct 100 is also illustrated therein in cross section along with drain tube 122.

In FIG. 5, handle 130 is a handle on an access door on the rear side of housing 12 which provides access to the interior of middle section 16 for servicing and/or repair or the like.

In operation, cap 70 may be removed along with plunger 80. One or more plastic bottles or other plastic containers may be inserted into chute 90. Electric motor 60 being operational rotates disk 42 of shredder 40 causing blades 44 and 46 to be rotated at a high rate of speed, up to 3600 RPM causing the bottles (includes other plastic containers by definition) to without prior crushing or compacting, quickly be shredded into small pieces which are blown by fan fins 56 to the periphery where they fall through duct 100 into bin 30. In this manner, a large number of bottles may be shredded into a compact volume and retained in bin 30 until it is time for them to be picked up by the recycling transportation system. Bin 30 also receives any fluids that may be left in bottles which are being shredded. When it comes time for recycles to be picked up, bin 30 may be slidably removed from bottom section 18 of housing 12. Preferably, the entire bin may be removed and transported to a container outside of the home or business setting. However, it is contemplated that bin 30 could also be partially removable wherein the shredded material would be scooped out of bin 40 into other containers. Bin 30 may be provided with a handle, such as a bar going across the center of it for carrying purposes. Another form of handle may be two diametrically opposed openings near the top of bin 30.

The present invention may be embodied in other specific forms without departing from the spirit or essential attributes thereof and, accordingly, reference should be made to the appended claims, rather than to the foregoing specification as indicating the scope of the invention.

I claim:

1. An apparatus, comprising:

a decorative housing shaped in the form of a bottle having an opening in its upper portion for receiving plastic bottles and a bin in its lower portion for receiving shredded plastic, said bin being slidably removable or at least extendable out from said bottle shaped decorative housing;

a shredder having a rotating disk with blades thereon spaced from said disk mounted within said decorative housing for shredding plastic bottles into shredded plastic which is collected in said bin;

said shredder being in the form of a substantially horizontal disk having blades mounted thereto, said blades being separated from said disk by a spacer, said disk being rotated by an electric motor;

said decorative housing being in the form of a beverage bottle is provided with an intake chute extending from an upper portion of said bottle to a mid portion of said bottle, said rotating disk shredder being mounted below said intake chute and an outflow duct being provided from a periphery of said rotating disk for transport of shredded plastic to said bin;

a pan being provided underneath said rotating disk with an axle of said motor passing through said pan, said pan being provided with a drain for draining fluid from said rotating disk shredder to said bin; and whereby used plastic bottles may be conveniently shredded for reduction in volume of the plastic bottles for storage and/or transportation.

2. An apparatus in accordance with claim 1 wherein said chute is provided with a plunger for providing pressure on plastic bottles to be shredded and forcing the plastic bottles into said rotating disk.

3. An apparatus in accordance with claim 1 wherein said disk is provided with fan blades on its lower surface.

4. An apparatus in accordance with claim 1 including a perforated pan mounted below said shredder for catching shredded plastic which may fall downwardly, but allowing liquid from the plastic bottles to pass therethrough.

5. An apparatus in accordance with claim 4 further including a pan mounted below said perforated pan for catching fluid from the plastic bottles, said pan having a concave shaped surface, a drain tube mounted at a lower end of said concave shaped surface, said drain tube connecting said pan to a duct, said duct emptying into said bin.

6. An apparatus, comprising:

a decorative housing, said decorative housing being shaped in the form of a bottle, said housing having a top section, a middle section and a bottom section;

an opening in said top section for receiving plastic bottles;

a bin in its lower section for receiving shredded plastic, said bin being at least partially removable or at least extendable out from said bottle shaped decorative housing;

a front wall of said bin forming a portion of said decorative housing;

a disk substantially horizontally mounted in said middle section of said housing;

an electric motor connected to said disk for rotating said disk;

a plurality of blades mounted to an upper surface of said disk, each of said plurality of blades having at least one sharpened edge, each of said blades being mounted a predetermined distance above said upper surface of said disk;

a plurality of fins mounted to a lower surface of said disk for moving air and shredded chips of plastic contained in the air to be thrown towards a periphery of said housing;

a chute extending from said opening to approximately a lower end of said first section and positioned over said disk;

a plunger moveably mounted in said chute;

a perforated pan mounted in said housing below said disk, said perforations being of a size that will not pass shredded chips of plastic, but will pass liquid;

a duct connected to said perforated pan and extending substantially to said bin;

a second pan mounted below said perforated pan and above said motor; and a drain connected to said second pan and emptying into said bin.

7. An apparatus in accordance with claim 6 wherein said blades are separated from said disk by a spacer.

8. An apparatus in accordance with claim 6 wherein said decorative housing in the form of a beverage bottle and said duct extends from a periphery of said rotating disk for transport of shredded plastic to said bin.

9. An apparatus in accordance with claim 6 wherein said second pan is provided underneath said disk with an axle of said motor passing through said second pan.

10. An apparatus in accordance with claim 6 wherein said second pan has a concave shaped surface, a drain tube mounted at a lower end of said concave shaped surface, said drain tube connecting said second pan to said duct, said duct emptying into said bin.

* * * * *